US009283656B2

(12) United States Patent
Schubert et al.

(10) Patent No.: US 9,283,656 B2
(45) Date of Patent: Mar. 15, 2016

(54) SYSTEMS AND METHODS FOR FLUIDIZING AN ABRASIVE MATERIAL

(75) Inventors: Ernst H. Schubert, Snoqualmie Pass, WA (US); Andrew Turpin, Kent, WA (US)

(73) Assignee: OMAX Corporation, Kent, WA (US)

( * ) Notice: Subject to any disclaimer, the term of this patent is extended or adjusted under 35 U.S.C. 154(b) by 577 days.

(21) Appl. No.: 13/436,354

(22) Filed: Mar. 30, 2012

(65) Prior Publication Data

US 2012/0252325 A1 Oct. 4, 2012

Related U.S. Application Data

(60) Provisional application No. 61/471,039, filed on Apr. 1, 2011.

(51) Int. Cl.

| | |
|---|---|
| ***B24C 7/00*** | (2006.01) |
| ***B24C 3/00*** | (2006.01) |
| ***B24C 1/04*** | (2006.01) |
| ***B24C 3/04*** | (2006.01) |

(52) U.S. Cl.

CPC . *B24C 1/045* (2013.01); *B24C 3/04* (2013.01); *B24C 7/003* (2013.01); *B24C 7/0007* (2013.01); *B24C 7/0038* (2013.01); *B24C 7/0084* (2013.01)

(58) Field of Classification Search

CPC ..... B24C 1/045; B24C 3/04; B24C 7/0084; B24C 7/003; B24C 7/0038; B24C 7/0007

USPC ..... 451/101, 102, 48, 38, 99

See application file for complete search history.

(56) References Cited

U.S. PATENT DOCUMENTS

| | | | | | |
|---|---|---|---|---|---|
| 3,014,665 | A | * | 12/1961 | Shames et al. | 239/107 |
| 3,073,070 | A | | 1/1963 | Mead | |
| 3,413,794 | A | | 12/1968 | Bell et al. | |
| 3,543,444 | A | | 12/1970 | Mehta | |
| 3,834,082 | A | | 9/1974 | Grudzinski | |
| 4,075,789 | A | | 2/1978 | Dremann | |
| 4,125,969 | A | | 11/1978 | Easton | |
| 4,253,610 | A | | 3/1981 | Larkin | |
| 4,522,597 | A | * | 6/1985 | Gallant | 433/216 |
| 4,698,940 | A | * | 10/1987 | Zwicker | 451/101 |
| 4,802,312 | A | | 2/1989 | Glaeser et al. | |
| 4,878,320 | A | | 11/1989 | Woodson | |

(Continued)

FOREIGN PATENT DOCUMENTS

GB 2198975 A 6/1988

OTHER PUBLICATIONS

U.S. Appl. No. 13/645,933, filed Oct. 5, 2012, Zhang et al.

(Continued)

*Primary Examiner* — Joseph J Hail
*Assistant Examiner* — Joel Crandall
(74) *Attorney, Agent, or Firm* — Perkins Coie LLP

(57) ABSTRACT

Systems and methods for fluidizing an abrasive particulate material for an abrasive water jet are disclosed herein. In one embodiment, the abrasive material is delivered to a metering orifice in a distributor. Pressurized pulses of air can be directed around a circumference of the distributor to at least partially fluidize the particulate material to facilitate the material passing through the metering orifice. From the metering orifice, the abrasive particulate material is entrained in a water jet for a cutting procedure or other suitable application.

31 Claims, 12 Drawing Sheets

(56) References Cited

U.S. PATENT DOCUMENTS

| | | | | |
|---|---|---|---|---|
| 4,984,397 | A | 1/1991 | Van Leeuwen | |
| 4,995,202 | A * | 2/1991 | Gardner et al. | 451/102 |
| 5,098,229 | A | 3/1992 | Meier et al. | |
| 5,107,630 | A | 4/1992 | Lodewijk | |
| 5,407,379 | A | 4/1995 | Shank et al. | |
| 5,441,441 | A | 8/1995 | Cook et al. | |
| 5,468,066 | A | 11/1995 | Hammonds | |
| 5,591,064 | A | 1/1997 | Spears, Jr. | |
| 5,643,058 | A | 7/1997 | Erichsen et al. | |
| 5,800,246 | A | 9/1998 | Tomioka | |
| 6,083,001 | A | 7/2000 | Deardon et al. | |
| 6,098,677 | A | 8/2000 | Wegman et al. | |
| 6,200,203 | B1 | 3/2001 | Xu et al. | |
| 6,227,768 | B1 | 5/2001 | Higuchi et al. | |
| 6,425,804 | B1 | 7/2002 | Pettit et al. | |
| 6,676,039 | B2 | 1/2004 | Lindsey et al. | |
| 7,040,959 | B1 | 5/2006 | Panuska et al. | |
| 7,465,215 | B2 | 12/2008 | Shimizu et al. | |
| 8,123,591 | B2 | 2/2012 | Olsen | |
| 8,308,525 | B2 | 11/2012 | Hashish et al. | |
| 8,342,912 | B2 | 1/2013 | Funatsu et al. | |
| 2001/0046833 | A1 * | 11/2001 | Hashish et al. | 451/101 |
| 2003/0166378 | A1 | 9/2003 | Fuksshimov et al. | |
| 2004/0132383 | A1 | 7/2004 | Langford et al. | |
| 2005/0017091 | A1 | 1/2005 | Olsen et al. | |
| 2005/0070205 | A1 | 3/2005 | Korovin et al. | |
| 2005/0239371 | A1 | 10/2005 | Togawa | |
| 2012/0021676 | A1 | 1/2012 | Schubert et al. | |
| 2012/0156969 | A1 | 6/2012 | Liu | |
| 2012/0196516 | A1 | 8/2012 | Funatsu et al. | |
| 2012/0252326 | A1 | 10/2012 | Schubert et al. | |
| 2013/0005225 | A1 | 1/2013 | Russo | |
| 2013/0267152 | A1 | 10/2013 | Tera et al. | |
| 2014/0045409 | A1 | 2/2014 | Zhang et al. | |

OTHER PUBLICATIONS

Operation Manual, Abrasive Delivery System, Type ADS-24-II, © Flow Europe GmbH Jul. 2000, 28 pages.

U.S. Appl. No. 13/436,459, filed Mar. 30, 2012, Schubert et al.

* cited by examiner

SYSTEMS AND METHODS FOR FLUIDIZING AN ABRASIVE MATERIAL

CROSS-REFERENCE TO RELATED APPLICATION(S) INCORPORATED BY REFERENCE

This disclosure claims priority to U.S. Provisional Patent Application No. 61/471,039, filed Apr. 1, 2011, entitled "SYSTEMS AND METHODS FOR FLUIDIZING AN ABRASIVE MATERIAL," which is incorporated herein by reference in its entirety. This disclosure also incorporates by reference in its entirety U.S. patent application Ser. No. 13/436,459, filed Mar. 30, 2012, and entitled "PARTICLE-DELIVERY IN ABRASIVE JET SYSTEMS."

TECHNICAL FIELD

The present disclosure is directed generally to abrasive jet systems, and more particularly to abrasive jet systems and methods for fluidizing an abrasive material for use with an abrasive water jet (AWJ).

BACKGROUND

Abrasive jet systems that produce high-velocity, abrasive-laden fluid jets for accurately and precisely cutting various materials are well known. Abrasive jet systems typically function by pressurizing water (or another suitable fluid) to a very high pressure (e.g., up to 90,000 pounds per square inch (psi) or more) by, for example, a high-pressure pump connected to an abrasive jet cutting head. The pressurized water is forced through an orifice at a very high speed (e.g., up to 2500 feet per second or more). The orifice forms the water jet. The orifice is typically a hard jewel (e.g., a synthetic sapphire, ruby, or diamond) held in an orifice mount. The resulting water jet is discharged from the orifice at a velocity that approaches or exceeds the speed of sound. The liquid most frequently used to form the jet is water, and the high-velocity jet may be referred to as a "water jet," or a "waterjet."

Abrasives can be added to the water jet to improve the cutting power of the water jet. Adding abrasives to the water jet produces an abrasive-laden water jet referred to as an "abrasive water jet" or an "abrasive jet." To produce an abrasive jet, the water jet passes through a mixing region in a nozzle. The abrasives can have grit mesh sizes ranging between approximately #36 and approximately #320, as well as other smaller and larger sizes. The abrasive can be a particulate matter under atmospheric (ambient) pressure or pressurized in an external hopper. The abrasive can be conveyed through a metering orifice via a gravity feed or a pressurized feed from the hopper. A quantity of abrasive regulated by the metering orifice is entrained into the water jet in the mixing region. Typical abrasives include garnet and aluminum oxide. The exceedingly fine sizes of the particulates can create difficulty in delivering a uniform, reliable quantity of the abrasive material.

The resulting abrasive-laden water jet is then discharged through a nozzle tip that is adjacent to a workpiece. Such abrasive jets can be used to cut a wide variety of materials. For example, the abrasive jet can be used to cut hard materials (such as tool steel, aluminum, cast-iron armor plate, certain ceramics and bullet-proof glass) as well as soft materials (such as lead). A typical technique for cutting with an abrasive jet is to mount a workpiece to be cut in a suitable jig or other means for securing the workpiece into position. The abrasive jet can be directed onto the workpiece to accomplish the desired cutting, generally under computer or robotic control.

DETAILED DESCRIPTION

Overview

Figure 1:
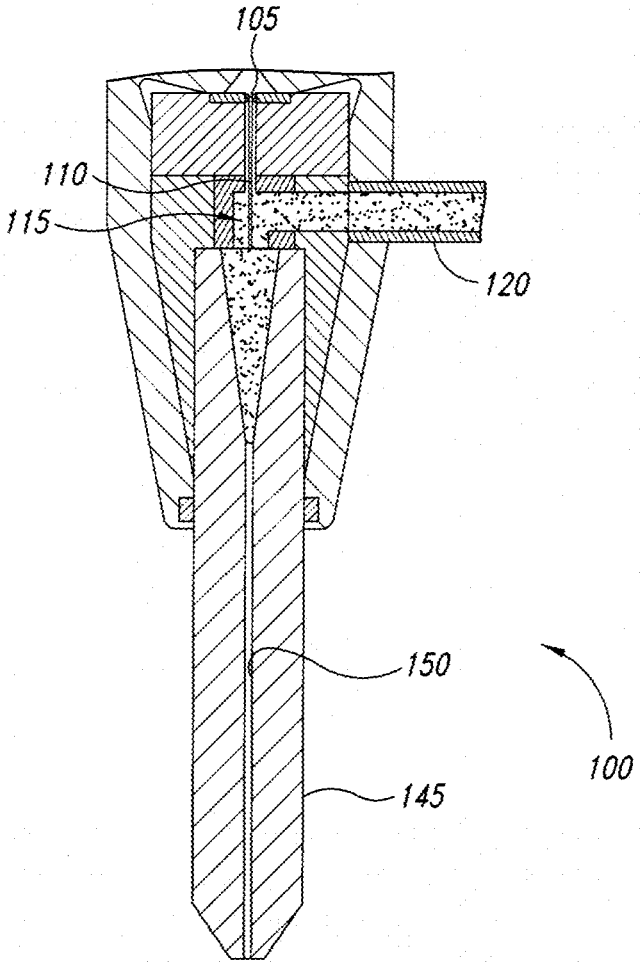
FIG. 1 is a cross-sectional side view of a portion of an abrasive jet nozzle assembly configured in accordance with an embodiment of the disclosure.

This application describes various embodiments of abrasive jet systems for cutting or otherwise processing materials, including abrasive jet systems using abrasive particulate materials. For example, abrasive jet systems as disclosed herein can be used with a variety of suitable working fluids or liquids to form the fluid jet. More specifically, abrasive jet systems configured in accordance with embodiments of the present disclosure can include working fluids such as water, aqueous solutions, paraffins, oils (e.g., mineral oils, vegetable oil, palm oil, etc.), glycol, liquid nitrogen, and other suitable abrasive jet cutting fluids. As such, the term "water jet" or "waterjet" as used herein may refer to a cutting jet formed by any working fluid associated with the corresponding abrasive jet system, and is not limited exclusively to water or aqueous solutions. In addition, although several embodiments of the present disclosure are described below with reference to water, other suitable working fluids can be used with any of the embodiments described herein. Moreover, although several embodiments of the present disclosure are described below with reference to air, other suitable gases can be used with any of the embodiments described herein. Certain details are set forth in the following description and in FIGS. 1-10 to provide a thorough understanding of various embodiments of the technology. Other details describing well-known aspects of abrasive jet systems, however, are not set forth in the following disclosure so as to avoid unnecessarily obscuring the description of the various embodiments.

According to embodiments of the present disclosure, a fluidizing system can deliver particulates such as fine powders and abrasive materials at relatively low rates to a nozzle assembly to form an abrasive water jet (AWJ). In some embodiments, the abrasive material can be a garnet, such as a #320 mesh garnet that passes through a distributor of a fluidizing system. In other embodiments, however, the abrasive material can include other suitable materials and sizes. The fluidizing system can use a controlled air stream, such as a pulsating air stream, to fluidize a portion of an accumulation of abrasives that are adjacent to a metering orifice in an end portion of the distributor. For example, the pulsed air stream can be delivered through gas flow passages extending longitudinally through the distributor and exiting the distributor at locations radially spaced apart from the metering orifice. The fluidizing system can also include a filter assembly that prevents the abrasive from back-flowing through the gas flow passages. In operation, when the flow of abrasive material is initiated, an initial pulse or burst of relatively higher pressure air flow can mobilize abrasives that have settled near the metering orifice of the end portion of the distributor. Following the initial pulse of air, a series of lower pressure pulses of air flow can create or sustain a generally fluidized state of the abrasive material. The pulsed air flow through the gas flow passages can also prevent the abrasive material from bridging otherwise resisting flow through the metering orifice. Once the abrasive material flows through the metering orifice it can pass to a collector and eventually travel to an abrasive jet nozzle assembly to be combined with a working fluid to form the abrasive jet.

According to additional embodiments of the present disclosure, the fluidizer system can also include an abrasive container or hopper that feeds the abrasive to the accumulation site proximate to the distributor. In certain embodiments, the fluidizing system can also include one or more aerators located in the hopper and configured to mix air with the abrasive material to maintain a uniform amount of entrained air in the abrasive over time. The aerators can also break down cavities and/or or "rat holes" that may form within the abrasive material in the hopper.

Fluidization as used herein generally refers to passing a pressurized gas through a body of collected or accumulated particulate material, such as an abrasive material. With sufficient pressure, the pressurized gas causes the particulate material to behave as a fluid, or to at least approximately behave as a fluid. In some embodiments, the fluidizing system of the present disclosure is configured to at least partially fluidize the abrasive material by passing pressurized air, such as pulsed pressurized air, through a quantity of the abrasive material accumulated proximate to an end portion of a distributor (e.g., an accumulation of abrasives collected in a settling tube or in a hopper coupled to the distributor). The air pulses can at least partially cause fluidization in the abrasive material.

Many of the details, dimensions, angles and other features shown in the Figures are merely illustrative of particular embodiments. Accordingly, other embodiments can have other details, dimensions, angles and features. In addition, further embodiments can be practiced without several of the details described below. In the Figures, identical reference numbers identify identical, or at least generally similar, elements.

Abrasive Jet Systems and Associated Methods

FIG. 1 is a cross-sectional side view of a portion of an abrasive jet nozzle assembly 100 configured in accordance with an embodiment of the disclosure. In the illustrated embodiment, the nozzle assembly 100 includes a mixing tube 145 having an axial passage 150. In some embodiments, the axial passage 150 can have an inside diameter of at least approximately 0.015 inch (0.38 mm). In other embodiments, however, the inside diameter of the axial passage 150 can be greater than or less than approximately 0.015 inch. The nozzle assembly 100 also includes a fluid inlet orifice or aperture 105. In certain embodiments, the orifice can have a diameter of at least approximately 0.007 inch (0.18 mm). In other embodiments, however the diameter of the orifice 105 can be less than or greater than 0.007 inch. Pressurized water (or other suitable working fluids) passes through the orifice 105, forming a fluid or water jet 110. The nozzle assembly 100 also includes an abrasive supply conduit 120 that conveys abrasives or particles to a mixing region 115 (alternatively referred to as a mixing cavity 115). The abrasives are mixed with the water jet 110 in the mixing region 115, thereby forming an abrasive jet. The abrasive jet is conveyed through the axial passage 150 of the mixing tube 145 before being expelled from the mixing tube 145. In certain embodiments, the abrasives can include garnet, aluminum oxide, baking soda, sugars, salts, ice particles, or other suitable abrasive particles.

Figure 2:
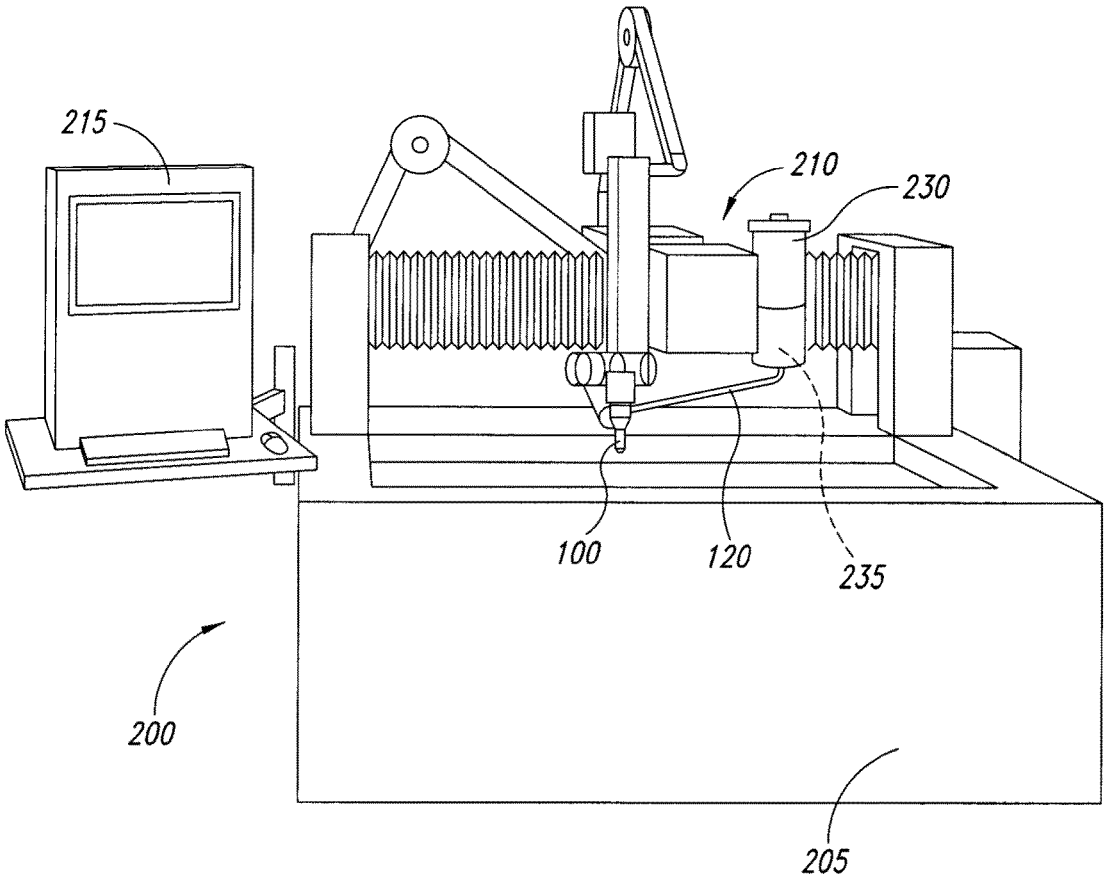
FIG. 2 an isometric view of an abrasive jet system configured in accordance with an embodiment of the disclosure.

FIG. 2 is an isometric view of an abrasive jet system 200 configured in accordance with an embodiment of the disclosure and which is suitable for use with the nozzle assembly 100 of FIG. 1. As shown in FIG. 2, the abrasive jet system 200 includes a base 205 and a mechanism 210 for moving the nozzle assembly 100. The abrasive jet system 200 may also include pressurized working fluid or water source, such as a pump (not shown in FIG. 2) that conveys highly pressurized water (e.g., from about 15,000 psi or less to about 60,000 psi or more) to the nozzle assembly 100. The abrasive jet system 200 also includes the abrasive supply conduit 120 that conveys abrasives 235 from an abrasive container 230 to the nozzle assembly 100. In some embodiments, the abrasive jet system 200 can also include pressurized or vacuum conveyance of abrasives 235 to the nozzle assembly 100. Additional details regarding the flow or conveyance of abrasives 235 are described in detail below. In the illustrated embodiment, the abrasive jet system 200 can also include a controller 215 that an operator may use to program or otherwise control the abrasive jet system 200.

Figure 3:
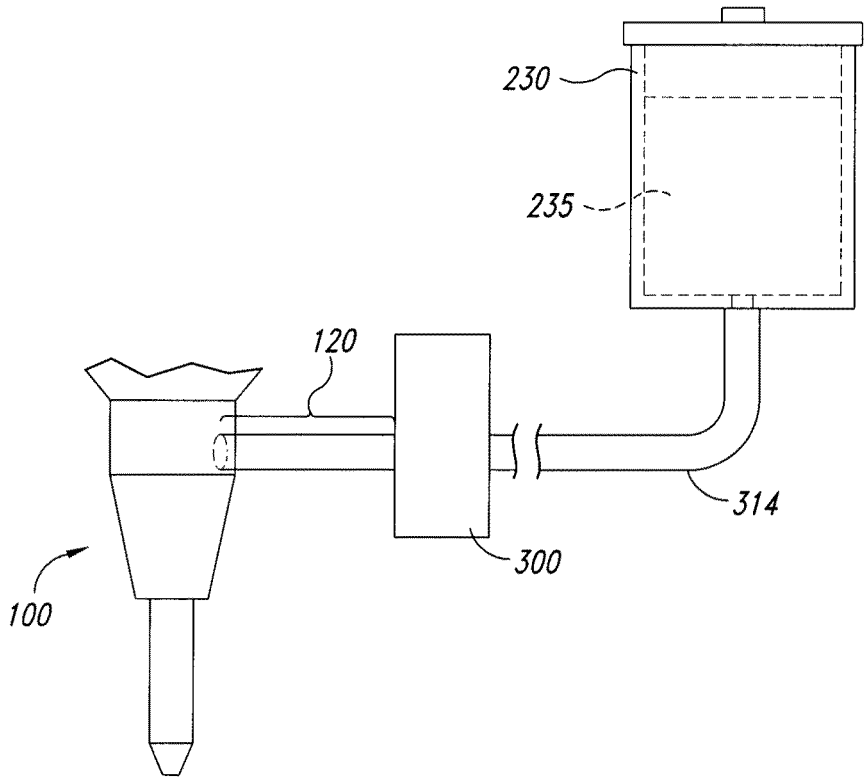
FIG. 3 is an enlarged side view of a portion of the abrasive jet system of FIG. 2 schematically illustrating a fluidizing assembly configured in accordance with an embodiment of the present disclosure.

FIG. 3 is an enlarged view of a portion of the abrasive jet system of FIG. 2, schematically illustrating a fluidizing system 300 configured in accordance with an embodiment of the disclosure and in relation to the nozzle assembly 100, the abrasive container 230 and the abrasive supply conduit 120. In the illustrated embodiment, the fluidizing system 300 is operably coupled to a distal end portion of the abrasive supply conduit 120. The fluidizing system 300 is also coupled to an abrasive feed conduit or drop tube 314 extending from the abrasive container 230 to convey abrasives 235 to the abrasive supply conduit 120 via the fluidizing system 300. As described in detail below, the fluidizing assembly 300 is configured to fluidize, disturb, unsettle, agitate, or otherwise mix the abrasive material 235 before the abrasive material enters the nozzle assembly 100. For example, the abrasive material 235 can include such small particles that the abrasive material 235 tends to clump or pack, even under ambient pressure and humidity conditions. The fluidizing system 300, however, can direct a series of pressurized pulses of air at predetermined locations to break up any packed portions or to prevent bridging and "rat holes" in the abrasives 235 before passing the abrasives 235 onward to the nozzle assembly 100.

Figure 4:
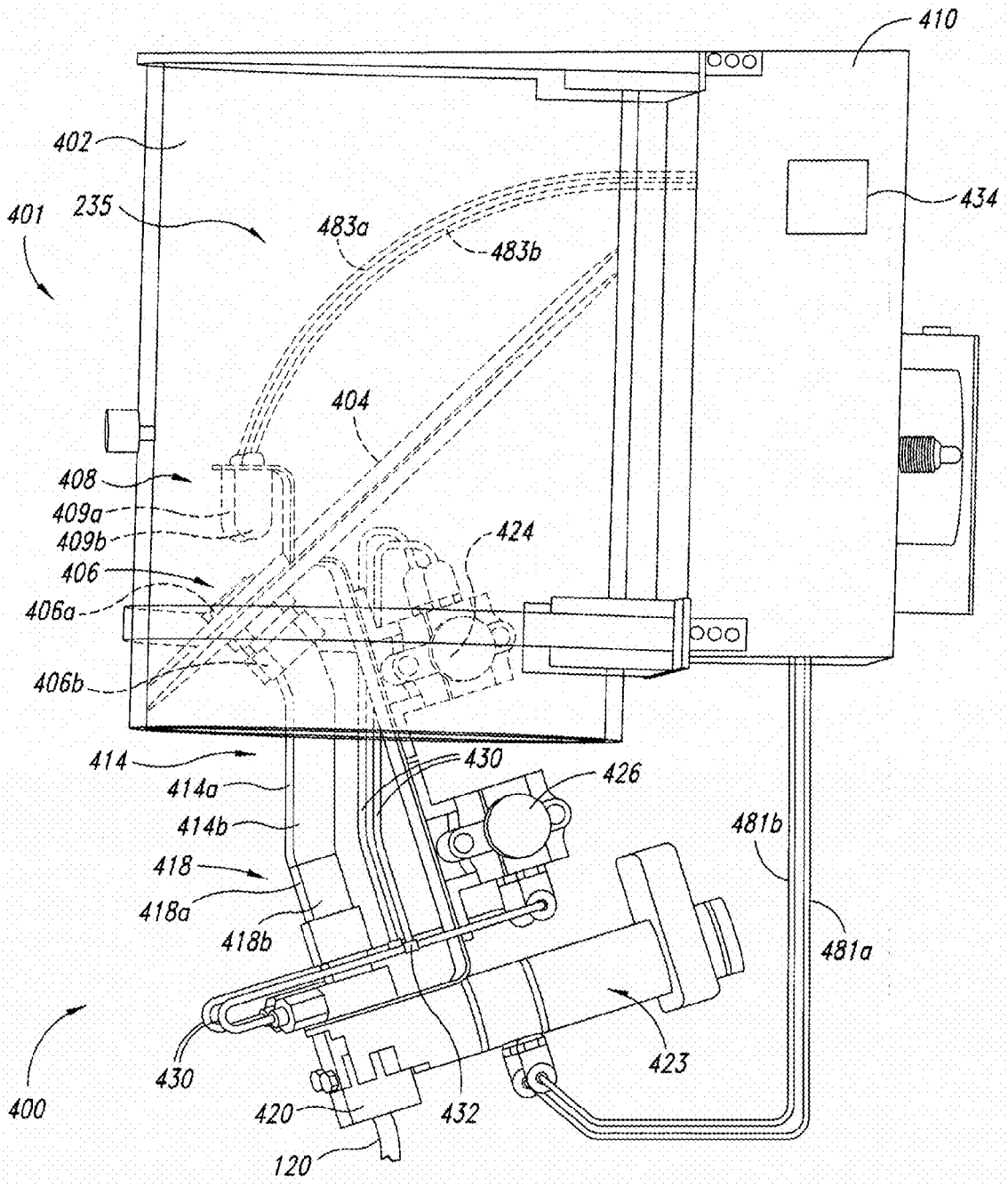
FIG. 4 is an isometric side perspective view of an abrasive jet subassembly including a distributor or fluidizer system configured according to an embodiment of the present disclosure.

FIG. 4 is a side perspective view of an abrasive jet system 401 including a fluidizer system 400 configured in accordance with embodiments of the present disclosure. The system 401 includes an abrasive container or hopper 402, a material director 404 within the hopper 402, hopper outlets or exit ports 406, hopper connector or drop tubes 414 leading to the fluidizer system 400, and a collector 420 downstream from the fluidizer system 400. The collector 420 is coupled to the abrasive supply conduit 120 and configured to direct the abrasive material 235 to a nozzle assembly 100. The flow of the abrasive material 235 through the fluidizer system 400 can be controlled by an abrasive valve 423, which can include a plunger or other suitable valve. The abrasive valve 423 can be pneumatically actuated via a controller 434 (shown schematically). For example, the abrasive valve 423 can be operably coupled to an air pressurizer 410 via gas delivery lines 481 (identified individually as a first gas delivery line 481*a* and a second gas delivery line 481*b*). The hopper 402 can be a cylindrical, plastic container configured to receive the abrasive material 235. The material director 404 can be a sloped plate positioned within the hopper 402 and configured to direct the abrasive material 235 toward the exit ports 406. The drop tubes 414 can be flexible, plastic tubes that engage corresponding fluidizer assemblies 418 (identified individually as a first fluidizer assembly 418*a* and a second fluidizer assembly 418*b*) of the fluidizer system 400. The hopper 402, material director 404, exit ports 406, and drop tubes 406 can be made of an abrasion-resistant material such as polyurethane or another suitable material.

The fluidizer system 400 can also include aerators 408 positioned within the hopper 402 and operably coupled to the air pressurizer 410 via corresponding gas delivery lines 483 (identified individually as a first gas delivery line 483*a* and a second gas delivery line 483*b*). The aerators 408 can comprise nozzles 409 (identified individually as a first nozzle 409*a* and a second nozzle 409*b*) positioned proximate or over the corresponding exit ports 406. The fluidizer system 400 can also include a burst solenoid assembly 424 and a fluidizer solenoid assembly 426, each of which is connected to the air pressurizer 410 by associated pressurized air delivery lines (not shown). The burst solenoid assembly 424 and the fluidizer solenoid assembly 426 are configured to deliver pulsed air flow and can be connected to the corresponding fluidizer assemblies 418 by gas delivery lines 430. In other embodiments, however, any suitable air pulse generator can be used in place of solenoid units. Moreover, in other embodiments, a single air pulse generator or other pressurized air source can be used rather than the burst solenoid assembly 424 and the fluidizer solenoid assembly 426. In some embodiments, the delivery lines 430 from the burst solenoid assembly 424 are connected to the delivery lines 430 frim the fluidizer solenoid assembly 426 with a "T" joint 432. In some embodiments, the burst solenoid assembly 424 and fluidizer solenoid assembly 426 each comprise two solenoid valves that are individually connected to a corresponding fluidizer assembly 418.

During operation, the controller 434 is configured to direct various portions of the system 400. For example, in response to a signal to deliver the abrasive material 235, the controller 434 can instruct the aerators 408 to convey air toward the exit ports 406 to at least partially fluidize the abrasive material 235 proximate to the exit ports 406. Conveying air through the aerators 408 can also counter-act back pressure that may be present in the exit ports 406 and drop tubes 414. The controller 434 can also instruct the burst solenoid assembly 424 and the fluidizer solenoid assembly 426 to fluidize the abrasive material 235 in the fluidizer assemblies 418, as well as direct the abrasive valve 423 to open and deliver the abrasive material 235 to the abrasive supply conduit 120.

In some embodiments, the fluidizer system 400 includes a first material path extending generally from the first exit port 406*a* proximate to the first aerator 408*a*, through the first drop tube 414*a*, and through the first fluidizer assembly 418*a*. The fluidizer system 400 can also include a second material path extending generally from the second exit port 406*b* proximate to the second aerator 408*b*, through the second drop tube 414*b*, and through the second fluidizer assembly 418*b*. In some embodiments, the components along the first material path and the second material path are substantially similar. In other embodiments, however, the fluidizer system 400 can include three or more material paths, which may be substantially similar to the first and second material paths. Moreover, the fluidizer system 400 can be retrofit to an existing waterjet or other appropriate assembly.

In embodiments including two or more material paths, the controller 434 can individually control the components along each of the material paths. For example, the controller 434 can alternate operation of the components along the two or more paths. In some embodiments, the controller 434 can operate the components of the first path for a brief time period (e.g., one second), then operate the components of the second path for the same brief time period. Moreover, the controller 434 can operate the components of the first and second paths 180° out of phase. Alternating operation of components of the first and second paths can improve the fluid flow of the abrasive material 235 through the first and second paths. The abrasive material 235 from the first and second paths can be diverted to disparate destinations, or to the same destination. In other embodiments, however, the controller 434 can operate the components along the first and second material paths simultaneously.

Figure 5:
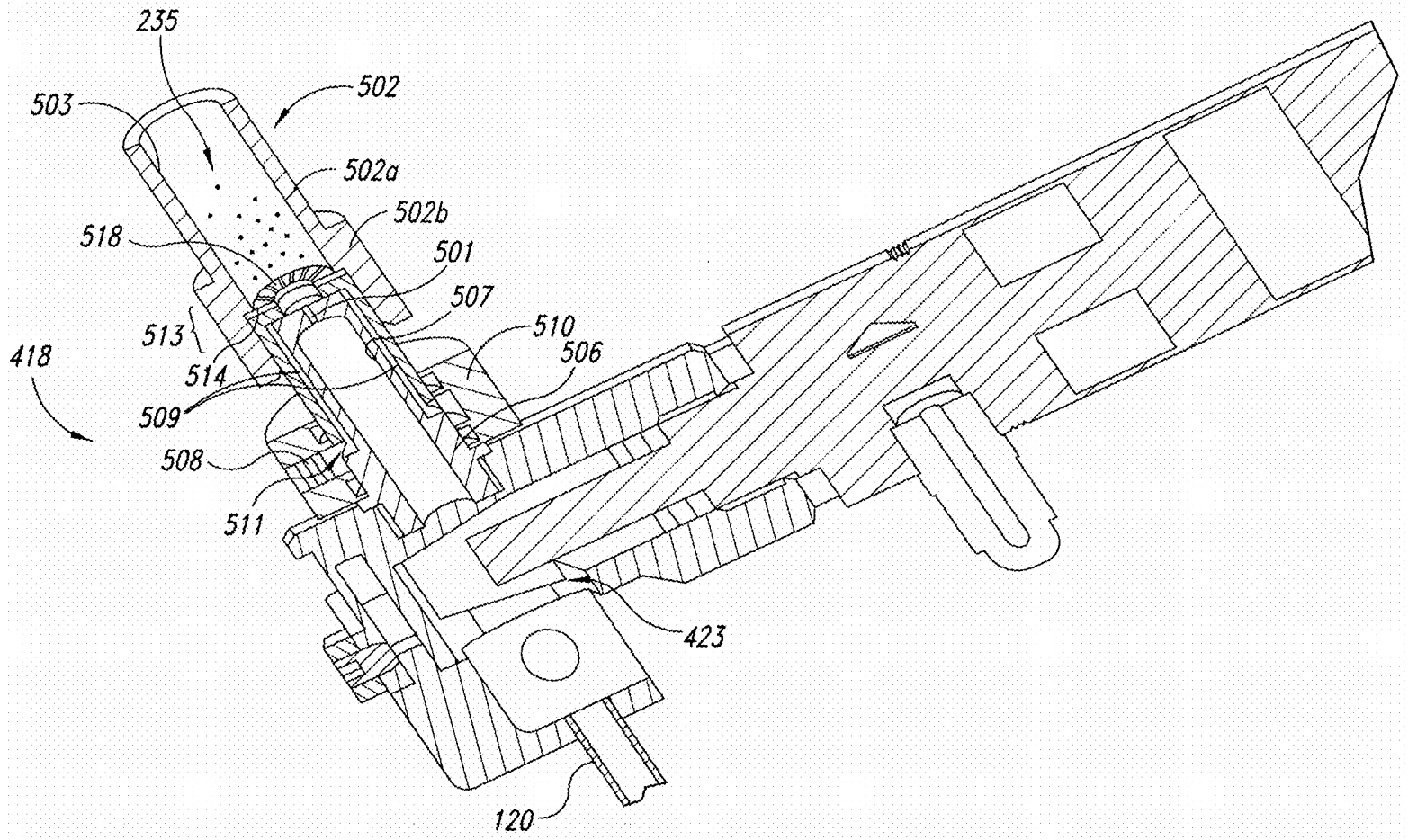
FIG. 5 is a cross-sectional isometric side view of a distributor or fluidizer assembly configured in accordance with an embodiment of the present disclosure.

FIG. 5 is a cross-sectional isometric side view of one of the fluidizer assemblies 418, the abrasive valve 423, and a portion of the abrasive delivery conduit 120 according to embodiments of the present disclosure. As shown in the illustrated embodiment, the fluidizer assembly 418 includes a filter holder, distributor coupler, or connector 502 operably coupled to a distributor 506. The fluidizer assembly 418 also includes a housing or manifold 510 coupled to the distributor 506. The housing 510 can comprise a cylindrical member configured to engage an external surface of the distributor 506. The housing 510 can include an air inlet port 511 that is in fluid communication with a corresponding air inlet port 508 in the distributor 506.

The filter holder 502 can comprise a cylindrical member having a particle flow passage or internal bore 503 through which the abrasive material 235 flows during use. As such, the internal bore 503 of the filter holder 502 can act as a settling tube configured to receive the abrasive material 235 and be made of an abrasion-resistant material, such as polyurethane or another suitable material. An upper portion 502*a* of the filter holder 502 can engage a corresponding drop tube 414 (FIG. 4), and lower portion 502*b* of the filter holder 502 can engage the distributor 506. In some embodiments, the filter holder 502 has a degree of flexibility and the lower portion 502*b* can snap or slide onto the distributor 506. In other embodiments, however, other suitable attachment mechanisms are possible, including threaded and o-ring fastening mechanisms.

The distributor 506 can also comprise a cylindrical member having a material flow passage or internal bore 507, and can include an air inlet 511 in fluid communication with air flow passages or conduits 509. The distributor 506 can be made of a metal such as aluminum, or a plastic such as polyurethane. In some embodiments, the distributor 506 is made of an electrically conductive material such as aluminum and electrically grounded to another portion of the fluidizer assembly 418 to disperse any static electricity that can accumulate in the abrasive material 235 as a result of the fluidizing operation. The distributor 506 also includes a metering orifice 501 generally axially or centrally aligned with the bore 503. The diameter of the metering orifice 501 is configured to permit the abrasive material 235 to pass through the metering orifice 501 at a desired rate. The diameter of the metering orifice 501 can therefore depend on the dimensions and type of the abrasive material 235, as well as other predetermined parameters of a cutting or other procedure for the abrasive material 235.

According to additional embodiments of the present disclosure, the fluidizer assembly 418 can also include a filter assembly 513 comprising a filter 514 and a screen 518 positioned between the filter holder 502 and the distributor 506. The filter 514 can be a woven polyurethane having openings or holes configured to prevent the abrasive material 235 from passing through the filter 514. In some embodiments, the holes are approximately 5 microns across. In other embodiments, however, the holes can be larger or smaller than 5 microns. Moreover, the screen 518 can be a rigid member positioned between the filter 514 and the filter holder 502. Further details of the filter assembly 513 are described in detail below with reference to FIG. 6.

In operation, the air inlet 508 of the housing 510 is connected to one of the air delivery lines 430 (FIG. 4) and configured to receive pressurized air from the burst solenoid assembly 424 and/or the fluidizing solenoid assembly 426. In certain embodiments, the air can be pulsed or flow at a constant rate or pressure. The pulsed air from the solenoid assemblies 424, 426 moves through the air inlet 508 of the housing 510, and enters the air inlet 511 of the distributor 506. The air can then travel through the flow passages 509 and through the filter assembly 513 to fluidize the abrasive material 235 accumulated at or near the filter assembly 513 to facilitate passage of the abrasives material 235 through the metering orifice 501. The filter assembly 513 can prevent the abrasive material from flowing back down the air flow passages 509.

Figure 6:
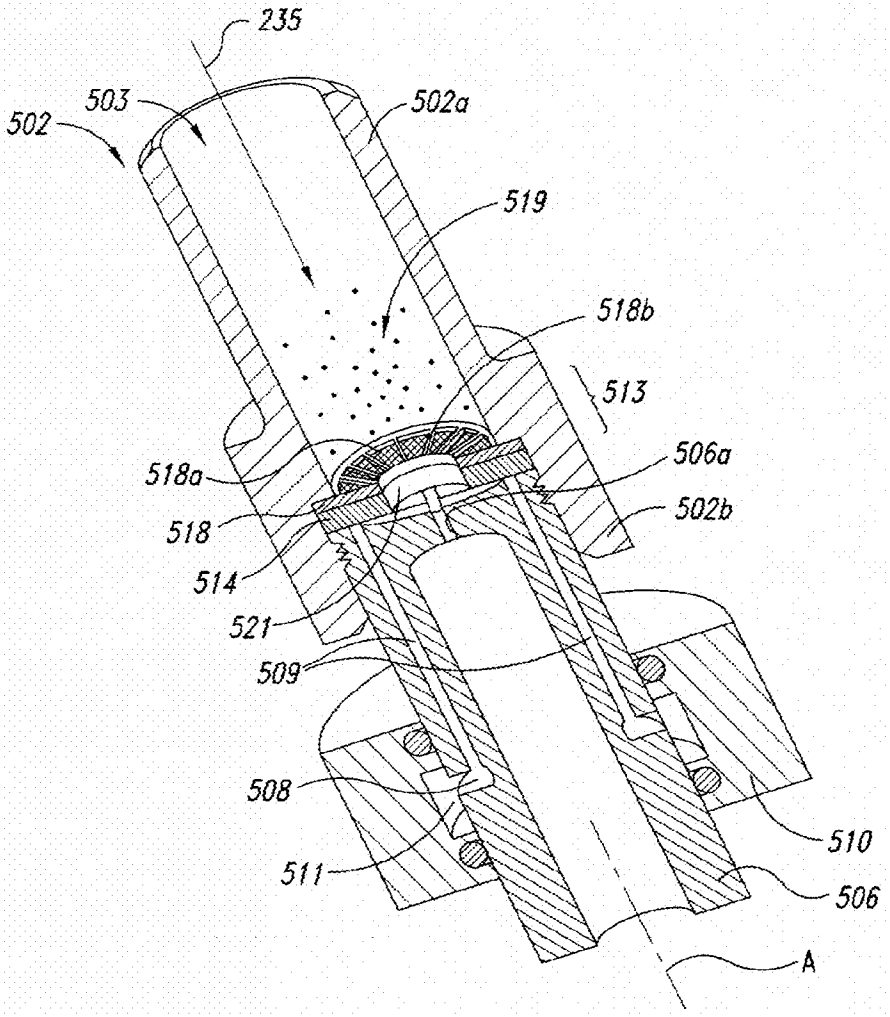
FIG. 6 is a cross-sectional isometric side view of components of the fluidizing assembly of FIG. 5.

FIG. 6 is a cross-sectional view of the filter holder 502, filter assembly 513, distributor 506, and housing 510 of FIG. 5. As shown in FIG. 6, the screen 518 includes screen sections 518*a* divided by separating members 518*b* extending radially outwardly from a central opening 521. In other embodiments, the screen 518 can be a mesh plate without the separating members 518*b*. The screen sections 518*a* can be a of fine mesh, such as a Dutch weave made of stainless steel and having holes of approximately 0.004 inch. In other embodiments, however, the holes can be greater or less than approximately 0.004 inch.

As also shown in FIG. 6, the air inlet 508 of the distributor 506 can be a channel or groove extending circumferentially around an exterior surface of the body the distributor 506. Moreover, the air flow passages 509 are in fluid communication with the air inlet 508 and extend from the air inlet 508 in a directly generally parallel with a longitudinal axis A of the distributor 506 to reach the filter assembly 513. As such, the air inlet 508 can deliver pressurized air through the distributor 506 to the filter assembly 513 via the flow passages 509 to fluidize the abrasive material 235 accumulated at the end portion of the distributor 506.

Figure 7A:
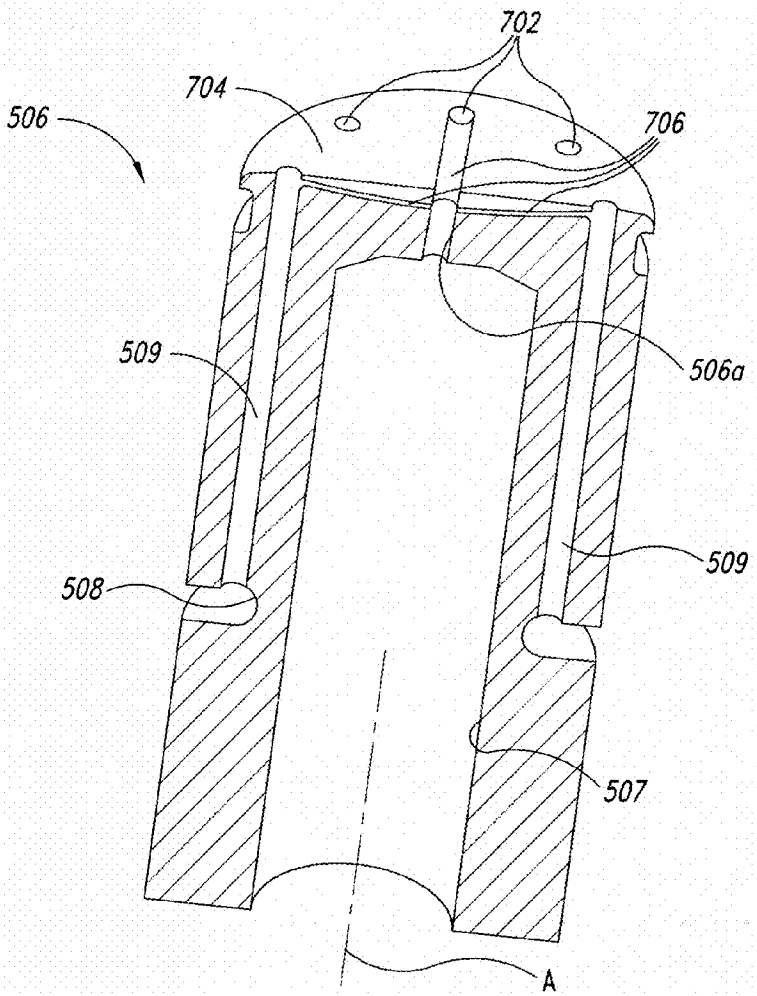
FIG. 7A is a cross-sectional isometric side view of a distributor configured in accordance with an embodiment of the present disclosure.

FIG. 7A is a cross-sectional isometric side view of the distributor 506 of FIG. 6. As described above, the distributor 506 can comprise a cylindrical body with a central bore 507 axially aligned with a metering orifice 501. The distributor 506 also includes a plurality of flow passages 509 radially spaced apart from the bore 507 and extending in a direction generally parallel to a longitudinal axis A of the distributor 506. In some embodiments, the distributor 506 can include eight flow passages 509 spaced evenly around the distributor 506. In other embodiments, however, the distributor 506 can include a greater or lesser number of flow passages 509. The flow passages 509 can terminate as exit openings 702 at an end portion 704 of the distributor 506. The end portion 704 can be configured to directly contact the filter assembly 513 (FIG. 6). The end portion 704 of the distributor 506 can also include grooves or channels 706 extending radially outwardly from the metering orifice 506*a* to a corresponding exit opening 702. In the illustrated embodiment, each groove 706 can have a generally tapered depth from the exterior surface of the end portion 704 that decreases from the metering orifice 506*a* as the groove 706 extends toward the corresponding exit opening 702. In other embodiments, however, each groove can have a generally constant depth or a depth that tapers in an opposite direction than that shown in FIG. 7A (e.g., that increases as the groove 706 extends toward the corresponding exit opening 702). In certain embodiments, exit openings 702 can be approximately 0.013 inch in diameter, and the grooves 706 can be approximately 0.02 inch wide and approximately 0.03 inch deep. In other embodiments, other dimensions and configurations can be used.

Figure 7B:
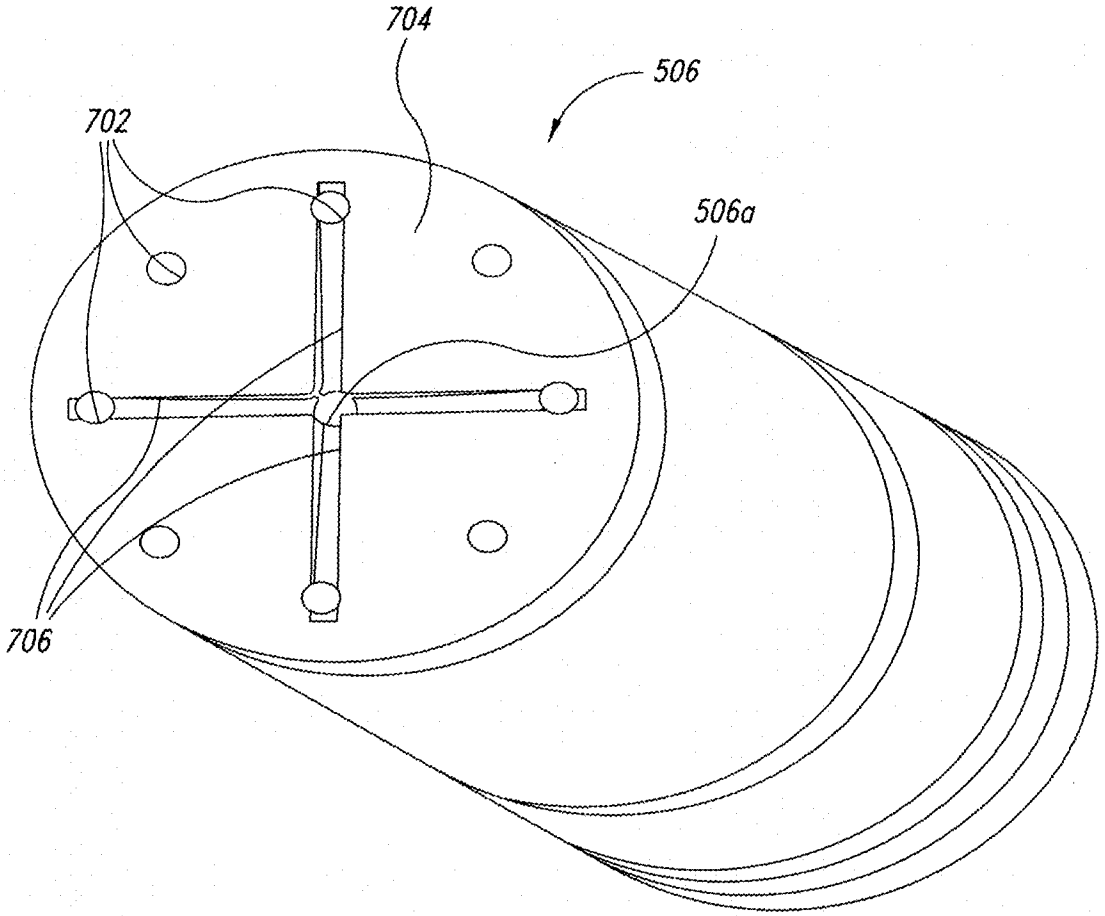
FIG. 7B is an isometric end view of the distributor of FIG. 7A.

FIG. 7B is an isometric end view of the end portion 704, the exit openings 702, and the grooves 706 of the distributor 506 according to embodiments of the present disclosure. In the illustrated embodiment, the end portion 704 includes four equally spaced apart grooves extending radially outwardly from the metering orifice 506*a* to individual corresponding exit openings 702. In other embodiments, however, the end portion 704 can include a greater or lesser number of grooves 706. In still further embodiments, other configurations of the grooves and/or exit openings 702 are possible as well. For example, other embodiments of the distributor can have different numbers of exit openings 702 and/or grooves 706 than those shown in FIG. 7B.

Figure 8A:
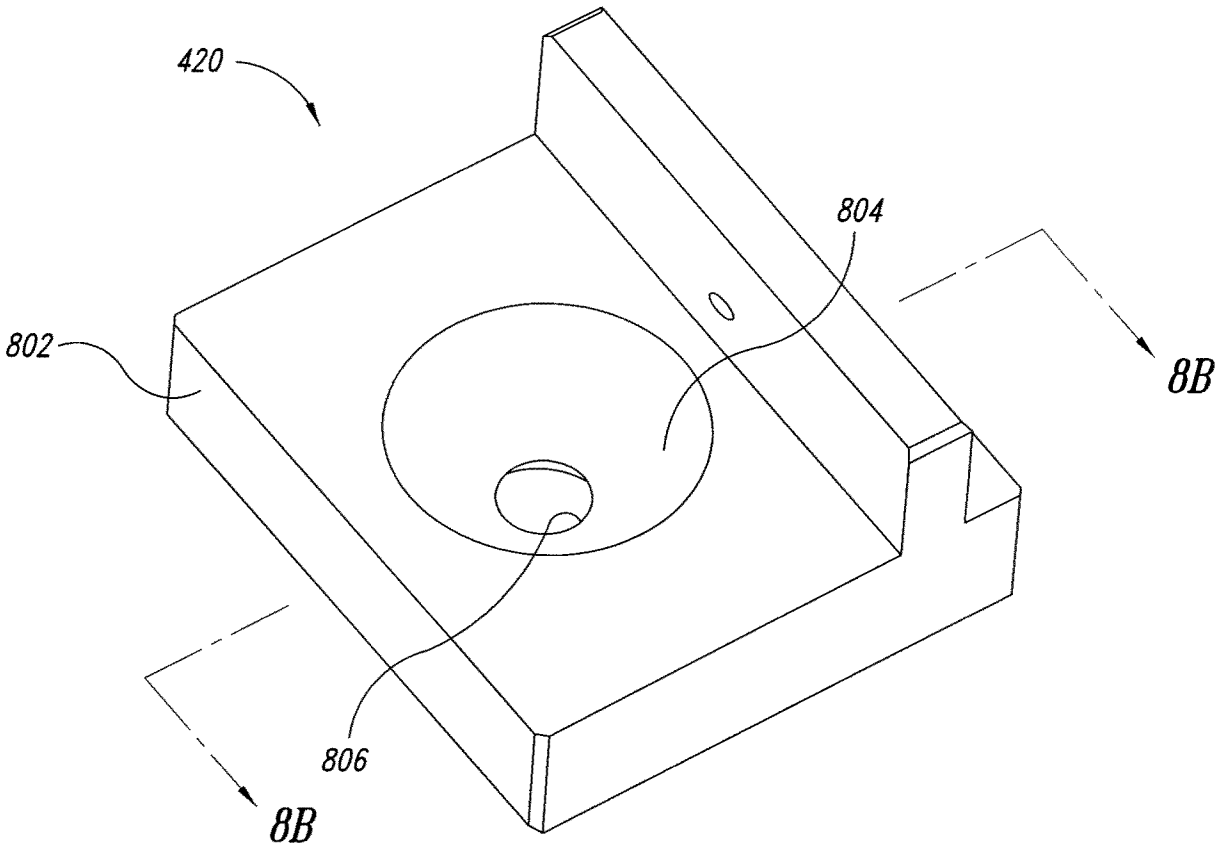
FIG. 8A is an isometric view of a collector configured in accordance with an embodiment of the disclosure.
Figure 8B:
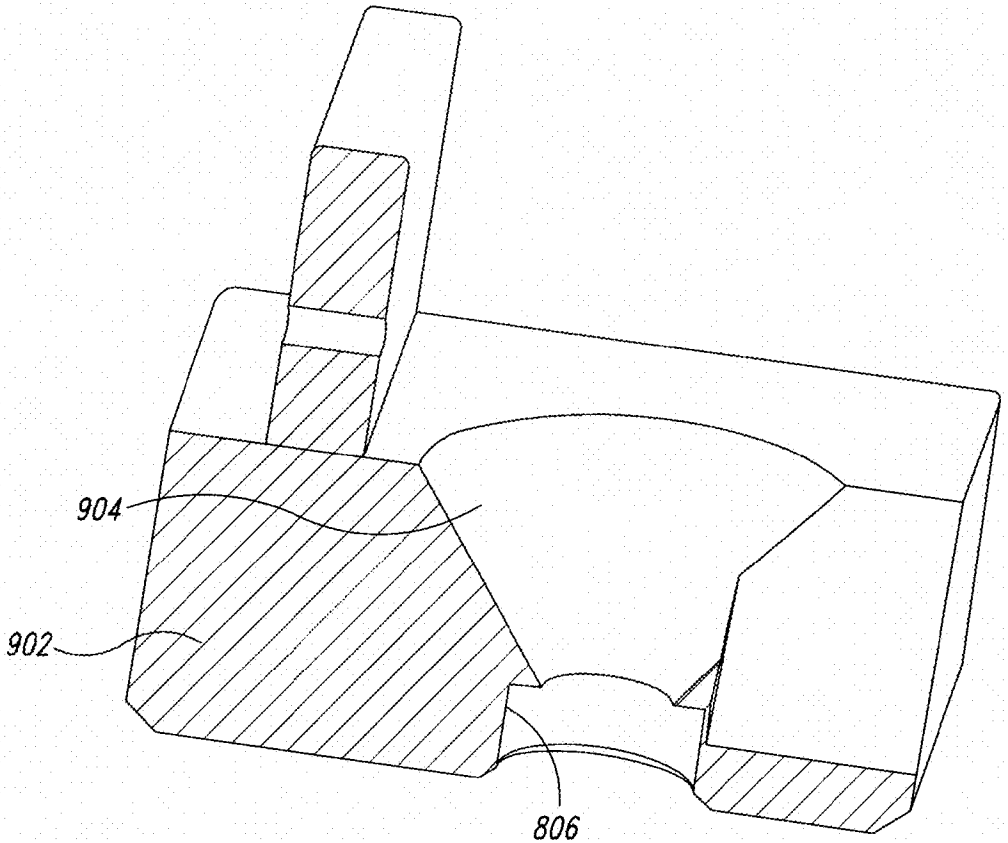
FIG. 8B is a cross-sectional isometric side taken substantially along lines 8B-8B in FIG. 8A.

FIG. 8A is an isometric view of the collector 420 of FIG. 4, and FIG. 8B is a cross-sectional isometric side view taken substantially along lines 8B-8B of FIG. 4. Referring to FIGS. 8A and 8B together, the collector 420 includes a body 802 that can be made of an abrasion-resistant material such as polyurethane and having a funnel surface 804 sloping toward an outlet opening 806. In other embodiments, however, the body 802 can be made from a metallic material, such as aluminum. The outlet opening 806 can be aligned with or otherwise coupled to an abrasive supply conduit for receiving the abrasive material after passing through the fluidizing assembly 418 and the metering orifice 501. The funnel surface 804 can have any appropriate slope that facilitates passage of the abrasive material and prevents the abrasive material from collecting. If the abrasive material 235 is allowed to collect, it may reach the water jet 110 in a non-uniform manner and impair the quality of a cut.

Figure 9:
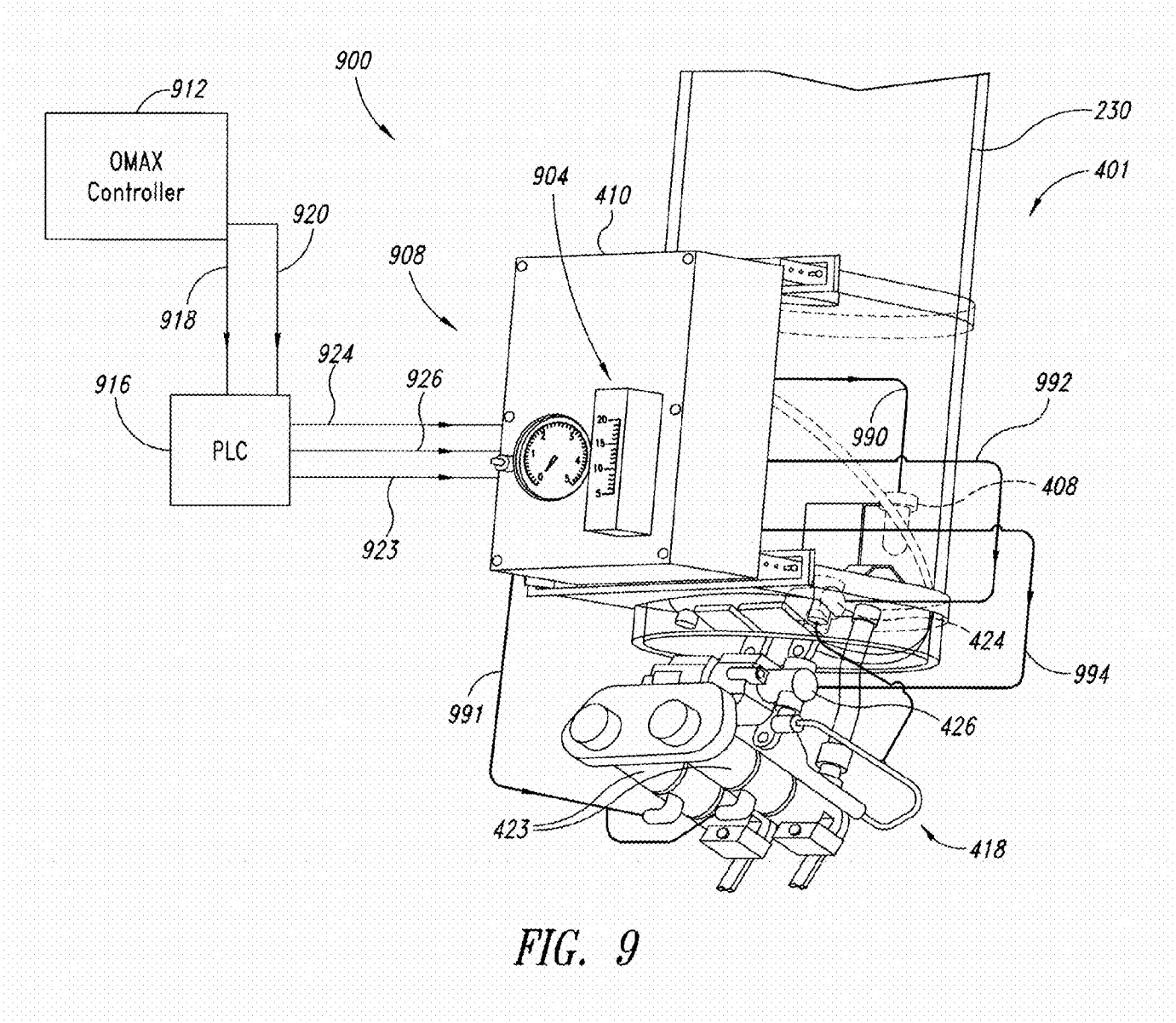
FIG. 9 is an isometric view of an abrasive jet system including a schematically illustrated control mechanism configured in accordance with an embodiment of the present disclosure.

Control Mechanisms and Processes Configured in Accordance with Additional Embodiments of the Disclosure FIG. 9 is an isometric view of the abrasive jet system 401 (FIG. 4) including a schematically illustrated control mechanism 900 configured in accordance with embodiments of the present disclosure. In the illustrated embodiment, the control mechanism 900 includes flow meter 904 and a pressure gauge 908 associated with the air pressurizer 410. As described above, the air pressurizer 904 is pneumatically connected to the aerators 408, the burst solenoid assembly 424, and the fluidizer solenoid assembly 426 to supply air or other suitable gases to each of these assemblies for fluidizing the corresponding abrasive material. The air pressurizer 410 can also be pneumatically connected to the abrasive valve 423. The control mechanism 900 includes a controller 912 coupled to a programmable logic controller (PLC) 916. The PLC 916 is configured to receive a "pump on" or gas flow signal 918 and/or an "abrasive on" or abrasive flow signal 920 from the controller 912. The PLC 916 can also be operably coupled to the air pressurizer 410 to transmit various control signals to the air pressurizer 410 during operation. For example, the PLC 916 can transmit a fluidizer solenoid signal 924, a burst solenoid signal 926, and/or an abrasive valve signal 923 to the air pressurizer 410. As such, the controller 916 and the PLC 916 can control the air pressurizer 410 to convey air flow from the fluidizer solenoid assembly 426 to the fluidizer assembly 418, air flow from the burst solenoid assembly 424 to the fluidizer assembly 418, and/or air flow to the abrasive valve 423 to control abrasive flow.

More specifically, when the controller 912 issues the "abrasive on" or abrasive flow signal 920, the PLC 916 can in turn instruct the air pressurizer 410 to deliver air to the abrasive valve 423 via an abrasive signal 991. Moreover, when the controller 912 issues the "pump on" or gas flow signal 918, the PLC 916 can in turn instruct the air pressurizer 410 to deliver air to the aerators 408 via an aerator signal 990, as well as to deliver air to the burst solenoid assembly 424 via burst signal 992. In some embodiments, in response to the burst signal 992, the burst solenoid assembly 424 can deliver a strong but transient burst of air to the fluidizer assembly 418 to unsettle the abrasive material 235 that has collected on the filter assembly 513 (FIGS. 4 and 5). For example, in one embodiment the burst solenoid assembly 424 can deliver a 25 psi burst of air for approximately 0.5 second to initially loosen or otherwise disturb the abrasive material 235. In other embodiments, however, the initial burst can be at a higher or lower pressure, as well as for a shorter or longer duration. After the initial burst, PLC 916 can instruct the fluidizer solenoid assembly 426 to deliver pulses of air through the same airway as the initial burst via a pulse signal 994 to at least partially fluidize the abrasive material. In one embodiment, for example, the pulses of air can be at approximately 1.5 psi at a frequency of approximately 50 Hz. Moreover, the throughput of the pulsed air flow from the fluidizer solenoid assembly 426 can be approximately 10 ft3/h. In other embodiments, however, the pulses of air can be at higher or lower pressures, as well as at higher or lower frequencies. Moreover, and as noted above, in certain embodiments a single air pulse generator or solenoid can provide the various pulses of air flow. For example, a single air pulse generator can provide an initial pulse or burst of air flow to the fluidizer assembly 418, followed by one or more subsequent pulses or bursts of air flow to the fluidizer assembly 418. In certain embodiments, the initial pulse of air can be at a higher pressure and/or for a different duration than the one or more subsequent bursts of air. In other embodiments, however, the initial burst of air can be at the same pressure or a lower pressure than the one or more subsequent bursts of air, as well as for the duration as the individual one or more bursts of air. These routines can be executed by the PLC 916 when the controller 912 sends one or more signals to convey abrasive material and/or air flow. Fluidizing the abrasive material with an initial burst followed by sustained pulses causes the abrasive material to evenly or uniformly flow from the abrasive container 230 to the corresponding nozzle assembly 100 (FIG. 3).

Figure 10:
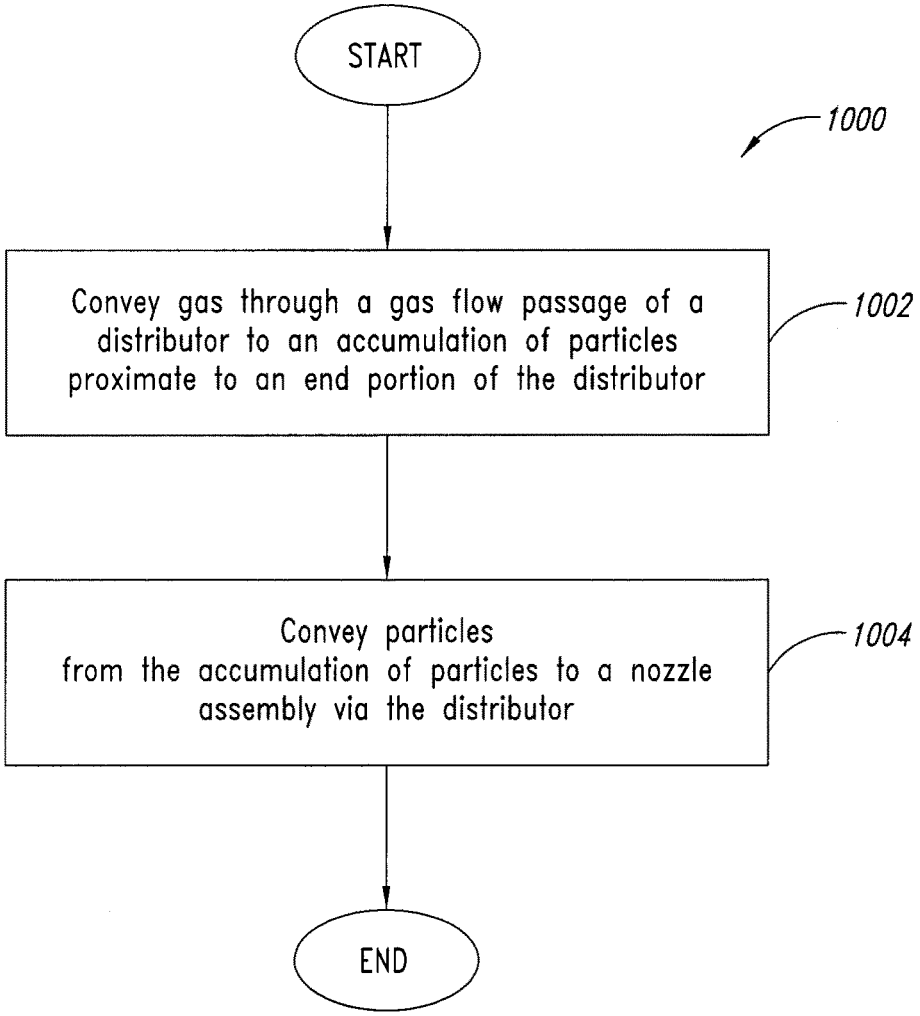
FIG. 10 is a flow diagram of a process for operating an abrasive jet system in accordance with an embodiment of the disclosure.

FIG. 10 is a flow diagram of a method or process 1000 for operating an abrasive jet system in accordance with an embodiment of the disclosure. The process 1000 includes conveying gas through a gas flow passage of a distributor to an accumulation of particles proximate to an end portion of the distributor (block 1002). Conveying gas through the gas flow passage can include at least partially fluidizing the particles proximate to a metering orifice in the end portion of the distributor that is configured to receive particles from the accumulation of particles. In addition, as described in detail above the gas flow passage can exit the end portion of the distributor at a location spaced apart from the metering orifice. In certain embodiments, conveying gas through the gas flow passage includes conveying gas through the gas flow passage at a first pressure and subsequently conveying gas through the gas flow passage at a second pressure that is different than the first pressure. For example, in some embodiments the second pressure can be less than the first pressure. In other embodiments, however, the second pressure can be greater than the first pressure, or the same as the first pressure. Moreover, conveying gas through the gas flow passage at the first pressure can also include conveying at least one pulse of gas at the first pressure and conveying gas through the gas flow passage at the second pressure can also include conveying at least one pulse of gas at the second pressure. In certain embodiments, the first pulse can be for a different duration (e.g., longer or shorter) than the subsequent at least one pulse. In other embodiments, the duration of these pulses can be the same.

According to additional features of the illustrated embodiment, conveying gas through the gas flow passage can include conveying gas through a plurality of gas flow passages that are radially spaced apart from the metering orifice and that extend in a direction generally parallel to a longitudinal axis of the distributor. Additionally, conveying gas through the gas flow passage can further include conveying gas through a screen assembly positioned at the end portion of the distributor. Moreover, in certain embodiments the accumulation of particles can be in an abrasive container and/or in a connector operably coupled to the distributor. For example, the accumulation of particles can be a first accumulation of particles in a connector extending between the distributor and an exit from abrasive container, and the process 1000 can further include conveying gas through an aerator to a second accumulation of particles proximate to the exit in the abrasive container.

The method also includes conveying particles from the accumulation of particles to a nozzle assembly via the distributor, wherein the particles pass through the metering orifice (block 1004). In certain embodiments, conveying particles from the accumulation of particles comprises opening a particle flow valve downstream from the distributor. After passing through the distributor, the particles can be combined with fluid to form an abrasive jet in a nozzle assembly.

From the foregoing, it will be appreciated that specific embodiments have been described herein for purposes of illustration, but that various modifications may be made without deviating from the spirit and scope of the present disclosure. Those skilled in the art will recognize that numerous liquids other than water, as well as numerous gases other than air, can be used with embodiments disclosed herein. Further, while advantages associated with certain embodiments have been described in the context of those embodiments, other embodiments may also exhibit such advantages, and not all embodiments need necessarily exhibit such advantages to fall within the scope of the present disclosure. Accordingly, the inventions are not limited except as by the appended examples.

We claim:

1. An abrasive jet system comprising:

an abrasive container configured to hold abrasives;

a nozzle assembly configured to combine a fluid with the abrasives; and an abrasive fluidizer assembly configured to be operably coupled to the abrasive container and the nozzle assembly to meter abrasives to the nozzle assembly from the abrasive container, wherein the fluidizer assembly comprises— a distributor having a distributor body with a first end portion upstream of a second end portion, the distributor body further comprising— a metering orifice at the first end portion;

an internal bore extending through the distributor body from the metering orifice to the second end portion and positioned to direct abrasives from the metering orifice, through the distributor body, and toward the nozzle assembly; and a flow passage having an exit opening at the first end portion, wherein the flow passage extends through at least a portion of the distributor body to the exit opening, and wherein the exit opening is positioned to deliver gas upstream of the internal bore; and a distributor coupler configured to be operably coupled to the first end portion of the distributor body and to receive accumulated abrasives at a collection portion proximate to the first end portion of the distributor body;

wherein gas exiting the distributor body via the exit opening passes through at least a portion of the accumulated abrasives.

2. The abrasive jet system of claim 1 wherein the flow passage is a first flow passage and wherein the distributor body further comprises a plurality of flow passages extending through at least a portion of the distributor body to the first end portion, wherein the plurality of flow passages are radially spaced apart from the metering orifice.

3. The abrasive jet system of claim 2 wherein the abrasive fluidizer assembly further comprises a filter assembly configured to be positioned proximate to the first end portion of the distributor body between the distributor coupler and the distributor, wherein the filter assembly comprises:

an opening aligned with the metering orifice; and a screen at least partially covering the exit opening of the flow passage.

4. The abrasive jet system of claim 1 wherein the distributor body further comprises an inlet port in fluid communication with the flow passage, wherein the inlet port extends circumferentially around the distributor body and the flow passage extends from the inlet port to the first end portion of the distributor body.

5. The abrasive jet system of claim 1 wherein the abrasive container includes an exit port and wherein the abrasive jet system further comprises:

at least one aerator positioned in the abrasive container and configured to direct gas through abrasives proximate to the exit port; and a connector operably coupled to the exit port and the distributor coupler, wherein the connector is configured to deliver abrasives from the abrasive container to the collection portion of the distributor coupler.

6. The abrasive jet system of claim 1 wherein the gas passing through at least a portion of the accumulated abrasives is configured to at least partially fluidize the abrasives proximate to the metering orifice.

7. The abrasive jet system of claim 1, further comprising a controller operably coupled to the fluidizer assembly, wherein the controller is configured to direct pulses of gas through the flow passage at predetermined intervals.

8. A distributor for an abrasive jet system, the distributor comprising:

a body having a first end portion and a second end portion, wherein the first end portion is configured to be positioned proximate to an accumulation of particles that are to be delivered to a nozzle assembly of the abrasive jet system, wherein the body further comprises— a metering orifice at the first end portion configured to receive particles from the accumulation of particles;

a particle flow passage extending from the metering orifice toward the second end portion and positioned to direct abrasives from the metering orifice, through the body, and toward the nozzle assembly, wherein the particle flow passage is in fluid communication with the metering orifice; and a gas flow passage having an exit opening at the first end portion, wherein the gas flow passage extends through at least a portion of the body to the exit opening, wherein the exit opening is positioned to deliver gas upstream of the particle flow passage, and wherein gas exiting the exit opening passes through at least a portion of the accumulation of particles.

9. The distributor of claim 8 wherein the body has a longitudinal axis and the metering orifice and particle flow passage are at least generally aligned with the longitudinal axis and the gas flow passage is radially spaced apart from the longitudinal axis.

10. The distributor of claim 8 wherein the gas flow passage is a first gas flow passage and wherein the body further comprises a plurality of spaced apart gas flow passages extending through at least a portion of the body to the first end portion.

11. The distributor of claim 8 wherein the body further comprises a channel formed in a surface of the first end portion, wherein the channel extends radially outwardly from the metering orifice.

12. The distributor of claim 11 wherein the channel extends between the metering orifice and the gas flow passage.

13. The distributor of claim 8, further comprising a gas inlet passage extending circumferentially around an exterior surface of the body, wherein the gas inlet passage is in fluid communication with the gas flow passage.

14. The distributor of claim 8, further comprising a filter positioned at the first end portion of the body.

15. The distributor of claim 14 wherein the filter at least partially covers the gas flow passage and includes a central opening generally aligned with the metering orifice.

16. The distributor of claim 8 wherein the first end portion is configured to be operably coupled to a connector extending from an abrasive container, wherein the connector is configured to receive abrasives from the abrasive container at a collection zone that at least partially contains the accumulation of particles.

17. A method of operating an abrasive jet system, the method comprising:

conveying pressurized gas through a gas flow passage of a distributor to an accumulation of particles upstream of and proximate to an end portion of the distributor, wherein the gas flow passage exits the end portion of the distributor at a location spaced apart from a metering orifice of the distributor, wherein the metering orifice is configured to receive particles from the accumulation of particles; and conveying particles from the accumulation of particles to a nozzle assembly via the distributor, wherein the particles pass through the metering orifice.

18. The method of claim 17 wherein conveying gas through the gas flow passage comprises pulsing gas through the gas flow passage to the accumulation of particles.

19. The method of claim 17 wherein conveying gas through the gas flow passage comprises conveying gas through the gas flow passage at a first pressure and subsequently conveying gas through the gas flow passage at a second pressure that is different than the first pressure.

20. The method of claim 19 wherein conveying gas through the gas flow passage at the first pressure comprises conveying at least one pulse of gas at the first pressure and conveying gas through the gas flow passage at the second pressure comprises conveying at least one pulse of gas at the second pressure.

21. The method of claim 17 wherein the accumulation of particles is a first accumulation of particles in a connector extending between the distributor and an abrasive container, and wherein the method further comprises conveying gas through an aerator to a second accumulation of particles proximate to an exit in the abrasive container, wherein the connector is operably coupled to the exit.

22. The method of claim 17 wherein conveying particles from the accumulation of particles comprises opening a particle flow valve downstream from the distributor.

23. The method of claim 17 wherein conveying gas through the gas flow passage comprises conveying gas through a plurality of gas flow passages, wherein individual gas flow passages are radially spaced apart from the metering orifice.

24. The method of claim 17 wherein conveying gas through the gas flow passage comprises conveying gas through a screen assembly positioned at the end portion of the distributor.

25. The method of claim 17 wherein conveying gas through the gas flow passage comprises at least partially fluidizing the particles proximate to the metering orifice.

26. A method of operating an abrasive jet system, the method comprising:

conveying particles of abrasive from an abrasive hopper toward a metering orifice via a drop conduit;

pulsing pressurized gas into an accumulation of the particles within the drop conduit upstream from the metering orifice;

metering the particles from the accumulation into a delivery conduit via the metering orifice; and conveying the metered particles toward a nozzle assembly of the abrasive jet system via the delivery conduit.

27. The method of claim 26 wherein pulsing the pressurized gas includes:

conveying an initial pulse of the pressurized gas at a first pressure, and conveying a series of subsequent pulses of the pressurized gas at a second pressure less than the first pressure.

28. The method of claim 26 wherein pulsing the pressurized gas includes pulsing the pressurized gas in an upstream direction.

29. The method of claim 26 wherein pulsing the pressurized gas includes pulsing the pressurized gas via an in-line distributor.

30. The method of claim 26 wherein pulsing the pressurized gas includes pulsing the pressurized gas via exit openings circumferentially distributed around a periphery of the drop conduit.

31. The method of claim 26 wherein conveying particles of abrasive from an abrasive hopper comprises conveying particles of abrasive by gravity.

* * * * *